United States Patent [19]

Hennemann et al.

[11] 4,335,024

[45] Jun. 15, 1982

[54] LIQUID DETERGENT COMPOSITIONS COMPRISED OF MIXTURES OF ALKYL POLYGLYCOL ETHERS AND QUATERNARY AMMONIUM COMPOUNDS

[75] Inventors: Manfred Hennemann, Hilden; Albrecht Loehr, Eggerscheid; Peter Krings, Krefeld; Rudolf Weber, Düsseldorf, all of Fed. Rep. of Germany

[73] Assignee: Henkel Kommanditgesellschaft auf Aktien, Düsseldorf-Holthausen, Fed. Rep. of Germany

[21] Appl. No.: 243,431

[22] Filed: Mar. 13, 1981

Related U.S. Application Data

[63] Continuation of Ser. No. 32,462, Apr. 23, 1979, abandoned.

[30] Foreign Application Priority Data

Jun. 1, 1978 [DE] Fed. Rep. of Germany ..... 2824024

[51] Int. Cl.[3] ..... C11D 1/835; C11D 1/62; D06M 13/46

[52] U.S. Cl. ..... 252/545; 252/8.8; 252/8.75; 252/153; 252/174.22; 252/547

[58] Field of Search ..... 252/8.75, 8.8, 8.9, 252/106, 153, 547, 174.21, 174.22, DIG. 1, DIG. 14, 545

[56] References Cited

U.S. PATENT DOCUMENTS

| | | | |
|---|---|---|---|
| 3,636,114 | 1/1972 | Tobler et al. | 260/567.6 |
| 3,682,849 | 8/1972 | Smith et al. | 260/615 B |
| 3,691,081 | 9/1972 | Thompson et al. | 252/174.22 |
| 3,959,157 | 5/1976 | Inamorato | 252/8.8 |
| 3,983,078 | 9/1976 | Collins | 252/540 |
| 4,038,196 | 7/1977 | Minegishi et al. | 252/8.8 |
| 4,058,473 | 11/1977 | Canter | 252/121 |
| 4,129,514 | 12/1978 | Caffarel et al. | 252/174.22 |
| 4,132,680 | 1/1979 | Nicol | 252/547 |
| 4,140,641 | 2/1979 | Ramachandran | 252/8.75 |
| 4,144,177 | 3/1979 | Minegishi et al. | 252/8.8 |
| 4,147,649 | 4/1979 | Arnau et al. | 252/539 X |
| 4,259,217 | 3/1981 | Murphy | 252/547 |

FOREIGN PATENT DOCUMENTS

| | | |
|---|---|---|
| 2426581 | 12/1974 | Fed. Rep. of Germany . |
| 2303850 | 11/1976 | France . |
| 2342364 | 10/1977 | France . |
| 830864 | 3/1960 | United Kingdom . |

*Primary Examiner*—P. E. Willis, Jr.
*Attorney, Agent, or Firm*—Hammond & Littell, Weissenberger and Muserlian

[57] ABSTRACT

An improved liquid detergent composition is comprised of:

(a) from about 5 to 18% by weight of a mixture of longer chain alkyl polyglycol ethers;

(b) from about 5 to 18% by weight of a second mixture of shorter chain alkyl polyglycol ethers, the quantitative ratio of component (a) to component (b) being from about 2:1 to 1:2; and (c) from about 2.5 to 10% by weight of a fabric-softening quaternary ammonium salt.

11 Claims, No Drawings

LIQUID DETERGENT COMPOSITIONS COMPRISED OF MIXTURES OF ALKYL POLYGLYCOL ETHERS AND QUATERNARY AMMONIUM COMPOUNDS

This is a continuation of U.S. patent application Ser. No. 032,462, filed Apr. 23, 1979 now abandoned.

FIELD OF THE INVENTION

The present invention is directed to a stable liquid detergent with fabric-softening action for simultaneously washing and softening delicate fabrics either in a washing machine or during washing by hand.

BACKGROUND OF THE INVENTION

For a long time there has been a need for a liquid fabric-softening, fine detergent which imparts to fabrics desired softening and antistatic properties during the washing process. Because of the known incompatibility of the conventional quaternary ammonium or imidazolinium fabric softeners with anionic surfactants, it has been impossible to use anionic surfactants in such liquid preparations. Therefore combinations of nonionic surfactants and quaternary ammonium compounds have been employed. Liquid detergents having such combinations are known from British Pat. No. 830,864, which discloses compositions containing nonionic surfactants and quaternary ammonium compounds with a long-chained alkyl radical and three short-chained alkyl radicals. According to the Journal *Seifen-Ole-Fette-Wachse* (1963) 4, p. 78, the washing effect of these combinations is particularly good if the ratio of the nonionic surfactant to the quaternary ammonium compound is in a quantitative ratio of 4:1 to 1:1.

Other nonionic surfactant-quaternary ammonium compound compositions are known. For example, DOS No. 2,426,581 describes a combination of a nonionic surfactant, a conventional softening quaternary ammonium compound with one or two long-chained alkyl radicals, as well as another quaternary ammonium compound with a methyl group, one or two long-chained alkyl groups, and one or two polyglycol ether groups. A liquid detergent comprised of a nonionic surfactant of the type of the alkyl polyglycol ethers or alkylphenol polyglycol ethers and a conventional fabric softener of the type of the di-higher-alkyl-dimethyl ammonium halides, as well as of a fatty acid polyglycol diester, is also known from DOS No. 2,529,444.

These liquid detergent compositions have not, however, been satisfactory, because no balance can be achieved with these detergents between washing ability, fabric-softening cpacity and sudsing behavior. U.S. Patent Application Ser. No. 032,467, filed Apr. 23, 1979, suggests that the disadvantages inherent in these detergents can be avoided by using a liquid detergent with a wash-active component of two defined nonionic surfactants of the type of the ethoxylated long-chained alcohols and with a softening component of a quaternary ammonium compound. The quaternary ammonium compounds used are particularly ammonium salts with two long-chained alkyl or alkenyl groups and two short-chained alkyl groups, particularly those compounds whose long-chained radicals are derived from saturated or unsaturated tallow fat alcohols, such as alkyl and alkenyl groups having 16 or 18 carbon atoms, examples of which include palmitoleyl, stearyl, oleyl, and linoleyl radicals.

The consumer demands that in addition to having satisfactory washing properties, a modern liquid detergent must be safe in use and stable in storage, and that it must meet certain expectations in terms of appearance and odor. In particular, the perfuming of a detergent must meet high standards. Not only does the favorable acceptance of a detergent frequently depend on whether it has a pleasant odor, but also the detergent perfume must effectively mask the frequently unpleasant odor of the wash liquor, thus supplementing the desired washing results by imparting to both freshly laundered damp wash and dry wash an odor giving the impression of cleanliness and freshness.

During the production of liquid detergents based on nonionic surfactants, which comprise from about 10 to 30% by weight, it has frequently been difficult to incorporate the necessary quantities of nonionic surfactants with conventional fabric softeners of the type of distearyldimethyl ammonium chloride or ditallow alkyldimethyl ammonium chloride with hardened tallow alkyl radicals, because of the low water solubility of these compounds. This has lead to mixtures that have been thickly liquid and difficult to pour, particularly at low storage temperatures, and therefore have required the use of large quantities of organic solvents. Though the perfuming of these mixtures has presented no problem, it has seemed advisable due to the unfavorable viscosity properties, to switch to other fabric softeners which do not have these drawbacks.

Other quaternary ammonium fabric softeners are known, such as derivatives of the unhardened tallow alcohols which contain particularly oleyl, but also palmitoleyl and linoleyl, radicals in a total amount of about 45% by weight. Although the mixtures prepared with this type of compound have desired viscosity properties, which are to a great extent independent of the temperature, such perfumed mixtures are not stable in storage. The lack of stability is manifested by a change of the odor to an unpleasant smell, as well as by a change in color of the liquid. The same observations have also been made with corresponding imidazolinium compounds having saturated or at least partly unsaturated long-chained aliphatic groups.

OBJECTS OF THE INVENTION

It is, therefore, an object of this invention to provide a liquid detergent having a fabric softener which can be formulated with a wash-active compound based on the two defined nonionic surfactants, which imparts to wash expected odor properties regarding softness, fluffiness, and antistatic finish, and which does not change the odor of the perfumed product in an undesired manner during storage.

More particularly, it is an object of this invention to provide a liquid detergent composition comprised of:

(a) from about 5 to 18% by weight of a mixture of alkyl polyglycol ethers of the formula

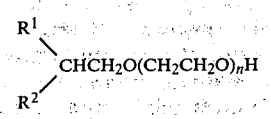

(I)

wherein $R^1$ represents a linear alkyl radical; $R^2$, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 11 to 15; and n represents an average value of from about 5 to 9, n being a value such that the ethylene oxide content represents from about 50 to 65% by weight, based on the total weight of the mixture of alkyl polyglycol ethers;

(b) from about 5 to 18% by weight of a mixture of alkyl polyglycol ethers of Formula I, wherein $R^1$ represents a linear alkyl radical; $R^2$ is a hydrogen atom or, in from about 20 to 75% of said alkyl polyglycol ethers, represents a $C_1$ to $C_4$ alkyl group and in from about 25 to 80% of said alkyl polyglycol ethers $R^2$ represents a hydrogen atom, the total number of carbon atoms in $R^1$ and $R^2$ together being from about 6 to 10, and n represents an average value of from about 3 to 8, n being of such a value that the ethylene oxide content represents from about 55 to 70% by weight, based on the total weight of the mixture of alkyl polyglycol ethers, the quantitative ratio of (a) to (b) being from about 2:1 to 1:2; and (c) from about 2.5 to 10% by weight of a compound of the formula

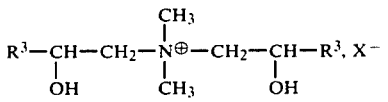

(II)

wherein $R^3$ represents a linear or branched alkyl radical having substantially from about 14 to 16 carbon atoms and $X^-$ represents an anion selected from the group comprised of chloro, bromo, methyl sulfato, ethyl sulfato, methane sulfonato, ethane sulfonato, and toluene sulfonato groups, or a mixture of said compounds.

DESCRIPTION OF THE INVENTION

This invention is directed to liquid detergent compositions of two nonionic surfactants and a fabric softener, which fabric softener imparts improved properties More specifically, the liquid detergent compositions are comprised of:

(a) from about 5 to 18% by weight, based on the total weight of the composition, of a mixture of alkyl polyglycol ethers of the formula

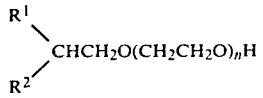

(I)

wherein $R^1$ represents a linear alkyl radical; $R^2$, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 11 to 15; and n represents an average value of from about 5 to 9, n being a value such that the ethylene oxide content represents from about 50 to 65% by weight, based on the total weight of the mixture of alkyl polyglycol ethers;

(b) from about 5 to 18% by weight, based on the total weight of the composition, of a mixture of polyglycol ethers of Formula I, wherein $R^1$ represents a linear alkyl radical; $R^2$ is a hydrogen atom or, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 6 to 10; and n represents an average value of from about 3 to 8, n being of such a value that the ethylene oxide represents from about 55 to 70% by weight, based on the total weight of the mixture of alkyl polyglycol ethers, the quantitative ratio of (a) to (b) being from about 2:1 to 1:2; and (c) from about 2.5 to 10% by weight, based on the total weight of the composition, of a compound of the formula

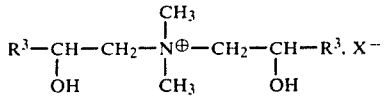

(II)

wherein $R^3$ represents a linear or branched alkyl radical having substantially from about 14 to 16 carbon atoms and $X^-$ represents an anion selected from the group comprised of chloro, bromo, methyl sulfato, ethyl sulfato, methane sulfonato, ethane sulfonato, and toluene sulfonato groups, or a mixture of said compounds.

The alkyl polyglycol ethers of Formula I which are suitable as component (a) are derived from alcohols obtained by reacting linear olefins with carbon monoxide and hydrogen according to known methods of hydroformulation and subsequent hydration. The reaction products, which comprise a mixture of linear and branched compounds, are known as oxo-alcohols. Commercial oxo-alcohol mixtures which are suitable for the preparation of surfactant component (a) are, for example, the alcohols known under the trade name "Dobanol", available from Deutsche Shell Chemie Gesellschaft, which have about 25% by weight of 2-alkyl branchings. Other suitable oxo-alcohols are oxo-alcohol mixtures with from about 50 to 70% by weight 2-alkyl branchings, available under the trade name "Synprol" from Imperial Chemical Industries Ltd. Other suitable products based on oxo-alcohols are, e.g., various "Lutensol" types from BASF, which products have from about 30 to 35% by weight of 2-branched alcohols, and some "Lial" types from Liquichimica S.p.A., which contain about 60% 2-branched alcohols.

Alkyl polyglycol ethers are prepared from the above-mentioned mixtures of oxo-alcohols by means of known methods of ethylene oxide condensation. According to the methods, the alkyl polyglycol ether mixtures will be comprised of compounds not all of which have the same number of ethylene oxide units, or groups. For example, as a result of the ethylene oxide condensation of a mixture of certain oxo-alcohols, the resulting mixture of alkyl polyglycol ethers where n, according to Formula I, represents an average value of 6, may be comprised of oxo-alcohols having from 3 to about 9 ethylene oxide groups.

Alkyl polyglycol ethers having from about 13 to 15 carbon atoms and an average ethylene oxide content of about 55 to 65% by weight, are preferred for component (a). Typical preferred compounds are, e.g., "Dobanol 45-7", which consists of at least 95% of $C_{14}/C_{15}$-oxo-alcohol with an average 7 moles of ethylene oxide, and "Lutensol AO-8" which represents a $C_{13}/C_{15}$-oxo-alcohol ethoxylate with an average of 8 moles of ethylene oxide.

Preferred component (b) compounds are alkyl polyglycol ethers whose alcohol bases represent natural or synthetic primary fatty alcohols or oxo-alcohols, containing from about 9 to 12 carbon atoms and having an ethylene oxide content from about 60 to 70% by weight. Typical preferred component (b) compounds are, e.g., the product "Marlipal KF" (available from Chemische Werke Huels), which represents a $C_{10}/C_{12}$-fatty alcohol ethoxylate with an average of 6 moles of ethylene oxide, as well as "Lutensol ON-70", which represents a $C_9/C_{11}$-oxo-alcohol ethoxylate with an average of 7 moles of ethylene oxide. Among the suitable fatty alcohols which form a basis for preferred alkyl polyglycol ethers are the alcohols available under the trade name "Lorol C-8 to 12" from Henkel KGaA.

The ratio of the amount of component (a) employed to the amount of component (b) employed substantially determines washing ability, sudsing behavior and fabric-softening action of the liquid detergent composition. Optimum results are obtained if the weight of ratio (a) to (b) is from about 2:1 to 1:2.

In general, total amounts of from about 10 to 30% by weight of component (b) are used, based on the total weight of the detergent, an amount of from about 15 to 30% by weight being preferred.

The quaternary ammonium compounds useful according to this invention as component (c) can be obtained by reacting 1 mole of methylamine with 2 moles of $C_{16}$–$C_{18}$ epoxide, which can be prepared by epoxidizing the corresponding alpha-olefin, and by subsequent quaternation. Preferred compounds of Formula II of those wherein alkyl radicals $R^3$ are substantially linear and contain 14 or 16 carbon atoms, with a ratio of $C_{14}$ radicals to $C_{16}$ radicals of from about 3:7 to 7:3. Such compounds are derived primarily from a mixture of $C_{16}$ and $C_{18}$ alpha-olefins. In practice, a mixture having about 35 to 45% by weight of alpha-$C_{16}$-olefin and from about 55 to 65% by weight of alpha-$C_{18}$-olefin, or from the epoxide product therefrom, is employed as starting material. The epoxide-methylamine-reaction product, which has been quaternized with methyl chloride or dimethyl sulfate to compounds of Formula II, is particularly suitable as component (c) of the preparation according to the invention.

In the description of the $R^3$ of Formula II as having substantially from about 14 to 16 carbon atoms, it is intended to indicate that at least about 95%, preferably at least about 98%, of the $R^3$ radicals have from about 14 to 16 carbon atoms and that the remainder have from about 1 to 20 carbon atoms. Similarly, in the description of the $R^3$ radicals as being substantially linear, it is intended to indicate that at least about 95%, preferably at least about 98%, of the $R^3$ radicals are linear and that the remainder are branched.

Quaternary ammonium compounds similar to those of Formula II have been known to be useful in the after-treatment of laundry. In U.S. Pat. No. 3,591,405, incorporated herein by reference, quaternary ammonium compounds are described in which long alkyl radicals corresponding to $R^3$ of Formula II are interrupted by ether, amide, or ester linkages or have up to two hydroxyl groups. The use of such compounds in powdered preparations is also described in U.S. Pat. No. 3,591,405, while the use of the compounds in liquid after-treatment preparations is the subject of Dutch Patent Application No. 68/08958, incorporated herein by reference. Reaction products corresponding to the quaternary ammonium compounds of Formula II are described in U.S. Pat. No. 3,636,114, incorporated herein by reference, as fabric softeners useful for the after-treatment of laundry.

In addition to the conventional quaternary ammonium compound with one or two long alkyl radicals, a number of quaternary ammononium compounds useful as fabric softeners and having a completely different structure are known: e.g., esters of sulfosuccinic acid and polyhydroxyamines (U.S. Pat. No. 4,056,558); imidazoline oxides (U.S. Pat. No. 3,607,765); higher tertiary aliphatic amines (DOS No. 26 46 995); alkyl ammonium carbamates (U.S. Pat. Nos. 4,025,444 and 3,962,100); and certain clays (U.S. Pat. No. 4,062,647). All these references are incorporated herein by reference.

Preferred compounds of Formula II include di-(2-hydroxyhexadecyl-)-dimethyl ammonium chloride and di-(2-hydroxyoctadecyl)-dimethyl ammonium chloride, either alone or in admixture. An especially preferred fabric softener is comprised of about 40 parts by weight of di-(2-hydroxyhexadecyl-)-dimethyl ammonium chloride and about 60 parts by weight of di-(2-hydroxyoctadecyl-)-dimethyl ammonium chloride. Likewise di-(2-hydroxyhexadecyl-)-dimethyl ammonium methyl sulfate, di-(2-hydroxytetradecyl-)-dimethyl ammonium methyl sulfate, di-(2-hydroxyoctadecyl)-dimethyl ammonium toluene sulfonate and di-(2-hydroxyoctadecyl-)-dimethyl ammonium methane sulfonate are preferred compounds.

In view of the limited teachings of the prior art, it is highly surprising that liquid detergents which contain a combination of quaternary ammonium compounds of Formula II as component (c) and the two nonionic surfactants of Formula I as compounds (a) and (b), have an optimum of softening action, washing power, and sudsing behavior in combination with easy perfumability, good storage stability, and low viscosity, even at low temperatures. The preparations according to this invention have the additional advantage that they show an optically appealing turbidity, even without the addition of special opacifiers, which are considered undesired ballast in the washing process.

The liquid detergents of this invention are also comprised of other components such as water, organic solvents, stabilizers, solubilizers, preservatives, enhancers, and the like. Water is the preferred additional component; however, one or more water-miscible organic solvents, such as lower alkanols or lower alkane diols or lower alkane polyols, can be used in addition to water. The water-miscible organic solvents include, for example, ethanol, isopropyl alcohol, ethylene glycol, propylene glycol, and glycerin. Also, polyol ether compounds such as lower-alkoxy-lower alkanols and lower alkoxy-lower alkoxy-lower alkanols like methyl, ethyl, or butyl ethers of diethylene glycol or their acetates (e.g., products available under the tradename "Cellosolve" from Union Carbode Corp.), can be used. Water can comprise from about 35 to 85% by weight, based on the total weight of the liquid detergent, and water-miscible organic solvents can be present in amounts up to 20% by weight, preferably 16% by weight. The preferred lower limit for the water-miscible organic solvents is on the order of 5% by weight.

To improve the solubility of the components, it is frequently advisable to use solubilizers, so-called hydrotropes, in addition to, or instead of, the abovementioned organic solvents. The preferred hydrotropes are nonsurfactant, organic sulfonates, e.g., $C_6$–$C_{10}$ alkanesulfonates, as well as the salts of toluene-, xylene- or cumene-sulfonic acid, preferably the alkanolamine- or alkali salts, most preferably the potassium salts. Urea is also suitable as a hydrotrope. Hydrotropes are added in amounts of from about 2 to 12% by weight, preferably from about 3 to 9% by weight, based on the total weight of the liquid detergent.

Additional auxiliary substances, such as, for example, opacifiers and viscosity standardizing agents, can be added to the detergents of this invention to improve certain properties. These additives include, for example, esters of alkanols or partial esters of polyols with long-chained fatty acids, like palmitic or stearic acid. A typical product is ethylene glycol stearate. These additives are present in small amounts, preferably from about 0.5 to 2.0% by weight, based on the total weight of the liquid detergent.

The liquid detergent may contain a small amount of a preservative such as, for example, formalin. The preservative will preferably be present in an amount of from about 0.05 to 1.0% by weight, based on the total weight of the liquid detergent.

Discoloration of the liquid detergent compositions can occur upon prolonged storage due to, for example, contamination with heavy metal ions during manufacture. To avoid such discoloration, sequestrants for heavy metal ions can be added. Such sequestrants include sodium, potassium, or triethanolamine salts of aminopolycarboxylic acids, such as ethylenediaminetetraacetic acid or nitrilotriacetic acid. Such sequestrants are used in small amounts, preferably in amounts of from about 0.1 to 1% by weight, based on the total weight of the liquid detergent.

Perfumes or dyes can be also added to the liquid detergent composition. Useful perfumes include substances with a flowery, fresh, or fruity odor or with a nuance known as "cosmetic" or "creamy". Useful dyes include, for example, red Xanthene dyes such as rhodamine B extra.

The liquid detergent compositions of this invention are formed by admixing components (a), (b), and (c) with water and additional additives and converting the admixture into a stable dispersion. This can be effected in a conventional manner by agitation—at elevated temperatures, if necessary—by means of agitators, dispersers, homogenizers, or the like. Preferably, distilled or demineralized water is used.

A preferred embodiment of the invention comprises a liquid detergent composition comprised of:

(a) from about 10 to 12.5% by weight of a mixture of alkyl polyglycol ethers of Formula I, in which $R^1$ and $R^2$ together have from 11 to 13 carbon atoms and in which the average ethylene oxide content is from about 55 to 65% by weight, based on the weight of the mixture of alkyl polyglycol ethers;

(b) from about 10 to 12.5% by weight of a mixture of alkyl polyglycol ethers of Formula I, in which $R^1$ has from 7 to 10 carbon atoms and $R^2$ is a hydrogen atom and in which the average ethylene oxide content is from about 60 to 70% by weight, based on the weight of the mixture of alkyl polyglycol ethers;

(c) from about 2.5 to 5% by weight of quaternary salts of Formula II wherein $R^3$ denotes a substantially linear alkyl radical of 14 to 16 carbon atoms and X− represents a chloro group, the weight ratio of $C_{14}$ to $C_{16}$ alkyl radicals being about 2:3; and (d) balance to 100% by weight of water and organic solvents, as well as other customary additives, e.g., dyes, perfumes, preservatives, or heavy metal sequestrants, which, if necessary, may be present in small amounts.

The detergents according to the invention can be used for simultaneously washing and softening delicate articles of wool, synthetic fibers, such as polyester, polyacrylic nitrile, and polyamide, and blends of wool and synthetic fibers. The washing and softening process can take place either in the washing machine or in hand washing, preferably at temperatures of up to about 40° C. The concentration of the preparations is generally from about 2 to 20 ml of liquid detergent per liter of wash liquor, preferably from about 3 to 6 ml per liter. The liquid detergents are characterized in that they clean the fabric properly and impart to them at the same time a pleasant feel and anti-electrostatic properties. During washing by hand in, for example, a sink, pleasant suds are formed; during washing in a washing machine, no oversudsing is observed. In addition, the suds can be rinsed out easily.

EXAMPLES

The following examples set forth the composition of several liquid detergents within the scope of the invention which were tested for their washing ability, softening properties, and sudsing behavior during washing by hand and machine washing. The fabric softener used in each example was comprised of a mixture of about 40 parts by weight di-(2-hydroxyhexadecyl-)-dimethyl ammonium chloride and about 60 parts by weight di-(2-hydroxyoctadecyl-)-dimethyl ammonium chloride (100 kg) used as an about 70% paste, the balance being isopropyl alcohol and water. The perfume oil used in each example had an odor nuance described as "flowery, fancy lavender with a radial fresh head note", and had the following composition:

350 parts lavender oil 40/42%
280 parts lavandine oil 30/32%
100 parts lemon oil, Italian
80 parts rosemary oil, Spanish
50 parts geranium oil, Bourbon
50 parts terpineol perfumery
50 parts patchouli oil Karimun
50 parts alpha-hexylcinnam aldehyde
20 parts ketone musk

EXAMPLE 1

| Component | Percent by Weight |
|---|---|
| Dobanol 45-7[1] | 15.0 |
| Marlipal KF[2] | 10.0 |
| Fabric softener | 4.0 |
| Ethanol/isopropyl alcohol mixture | 5.0 |
| 1,2-propylene glycol | 10.0 |
| Tetrasodium salt of ethylenediamine-tetraacetic acid | 0.2 |
| Formalin (35% solution) | 0.1 |
| Rhodamin B extra | 0.00006 |
| Perfume oil | 0.5 |
| $H_2O$ | balance |

[1]Mixture of $C_{14}$ and $C_{15}$-oxo-alcohol ethoxylate having an average of 58% by weight ethylene oxide content (available from Deutsche Shell Chemie).
[2]Mixture of $C_{10}$ and $C_{12}$-fatty alcohol ethoxylate having an average of 60% by weight ethylene oxide content (available from Chem. Werke Huels).

The above-described liquid detergent composition, which contains conventional additives in usual amounts, was tested and demonstrated a combination of optimum properties regarding washing ability, fabric softening action, and sudsing behavior for washing delicate fabrics in a washing machine at 40° C. and by hand. A similar, comparative liquid detergent composition was prepared which contained the same amount of a different fabric softener, namely, di-(tallow alkyl)-dimethylammonium chloride, derived from unsaturated tallow alcohol radicals.

Both liquid detergent compositions were stored at temperatures of from −10° C. to 40° C. for seventy days in 750 ml PVC bottles. It was found that the appearance of the preparation according to this invention and of the wash liquors and the odor of the washed fabrics were considered by a panel of experienced judges to be practically equal to the odor and appearance of freshly produced detergent and wash liquor thereof. In contrast, the odor of the comparative detergent was found by the panel to have changed to the extent that it was highly objectionable.

EXAMPLE 2

| Component | Percent by Weight |
|---|---|
| Dobanol 45-7 | 11.5 |
| Lorol $C_{10}/C_{12}$ 6AO[3] | 11.5 |
| Fabric softener | 3.5 |
| Ethanol/isopropyl alcohol mixture | 3.0 |
| 1,2-propylene alcohol | 3.0 |
| Perfume oil | 0.5 |
| $H_2O$ | balance |

[3]Mixture of $C_{10}$ and $C_{12}$ fatty alcohol ethoxylate having an average of 60% by weight ethylene oxide content (available from Henkel KGaA).

EXAMPLE 3

| Component | Percent by Weight |
|---|---|
| Dobanol 45-7 | 12.5 |
| Lutensol ON 70[4] | 12.5 |
| Fabric softener | 3.0 |
| Ethanol/isopropyl alcohol mixture | 5.0 |
| 1,2-propylene glycol | 5.0 |
| Perfume oil | 0.5 |
| $H_2O$ | balance |

[4]Mixture of $C_9$ and $C_{11}$-oxo-alcohol ethoxylate having an average ethylene oxide content of 66% by weight (available from BASF).

EXAMPLE 4

| Component | Percent by Weight |
|---|---|
| Dobanol 45-7 | 5.5 |
| Marlipal KF | 16.5 |
| Fabric softener | 4.0 |
| Ethanol/isopropyl alcohol mixture | 3.0 |
| 1,2-propylene glycol | 3.0 |
| Perfume oil | 0.5 |
| $H_2O$ | balance |

EXAMPLE 5

| Component | Percent by Weight |
|---|---|
| Lutensol AO 8[5] | 13.0 |
| Marlipal KF | 11.0 |
| Fabric softener | 4.0 |
| Ethanol/isopropyl alcohol mixture | 5.0 |
| 1,2-propylene glycol | 7.0 |
| Perfume oil | 0.5 |
| $H_2O$ | balance |

[5]Mixture of $C_{13}$ and $C_{15}$-oxo-alcohol ethoxylate having an average of 62% by weight ethylene oxide content (available from BASF).

EXAMPLE 6

| Component | Percent by Weight |
|---|---|
| Dobanol 45-7 | 15.0 |
| Lutensol ON 70 | 11.0 |
| Fabric softener | 3.0 |
| Ethanol/isopropyl alcohol mixture | 5.0 |
| 1,2-propylene glycol | 9.0 |
| Perfume oil | 0.5 |
| $H_2O$ | balance |

EXAMPLE 7

| Component | Percent by Weight |
|---|---|
| Lutensol AO 8 | 11.0 |
| Lutensol ON 70 | 14.0 |
| Fabric softener | 5.0 |
| Ethanol/isopropyl alcohol mixture | 4.0 |
| 1,2-propylene glycol | 4.5 |
| Perfume oil | 0.5 |
| $H_2O$ | balance |

Comparative liquid detergent compositions corresponding to each of Examples 2 to 7 in which the fabric softener was instead di-(tallow alkyl)-dimethylammonium chloride, derived from unsaturated tallow alcohol radicals, were prepared. Then the compositions of Examples 2 to 7 and the corresponding comparative samples were tested and evaluated in the same manner as in Example 1. In each instance the liquid detergent compositions of this liquid remained stable and the corresponding compositions exhibited unpleasant odors or unpleasant odors and other signs of instability such as separation or color change.

The above examples are set forth for the purpose of demonstrating the invention herein and are not to be construed as limiting the invention thereto.

We claim:

1. A liquid detergent composition comprised of:

(a) from about 5 to 18% by weight of a mixture of alkyl polyglycol ethers of the formula

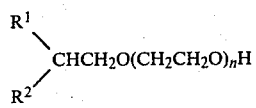

(I)

wherein $R^1$ represents a linear alkyl radical; $R^2$, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 11 to 15; and n represents an average value of from about 5 to 9, n being a value such that the ethylene oxide content represents from about 50 to 65% by weight, based on the total weight of the mixture of alkyl polyglycol ethers;

(b) from about 5 to 18% by weight of a mixture of polyglycol ethers of Formula I, wherein $R^1$ represents a linear alkyl radical; $R^2$ is a hydrogen atom or, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 6 to 10; and n represents an average value of from about 3 to 8, n being of such a value that the ethylene oxide content represents from about 55 to 70% by weight, based on the total weight of the mixture of alkyl polyglycol ethers, the quantitative ratio of (a) to (b) being from about 2:1 to 1:2, and (c) from about 2.5 to 10% by weight, of a compound of the formula

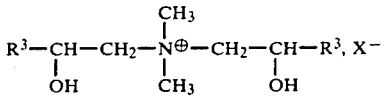

(II)

wherein $R^3$ represents a linear or branched alkyl radical having substantially from about 14 to 16 carbon atoms and $X^-$ represents an anion selected from the group comprised of chloro, bromo, methyl sulfato, ethyl sulfato, methane sulfonato, ethane sulfonato, and toluene sulfonato groups, or a mixture of the compounds.

2. The liquid detergent composition of claim 1, wherein radicals $R^3$ in component (c) are substantially linear alkyl radicals of 14 or 16 carbon atoms and the ratio of $C_{14}$ to $C_{16}$ radicals is from about 3:7 to 7:3.

3. The liquid detergent composition of claim 1, wherein the compounds of Formula II are derived from an olefin mixture having from about 35 to 45% by weight alpha-$C_{16}$-olefin and from about 55 to 65% by weight alpha-$C_{18}$-olefin, based on the total weight of the olefin mixture.

4. The liquid detergent composition of claim 1 wherein $X^-$ represents a chloro or methyl sulfato group.

5. The liquid detergent composition of claim 1 wherein component (a) plus component (b) together represent from about 10 to 30% by weight.

6. The liquid detergent composition of claim 1 wherein component (a) plus component (b) together represent from about 15 to 30% by weight.

7. The liquid detergent composition of claim 1 wherein $R^1$ and $R^2$ of component (a) together contain from about 11 to 13 carbon atoms.

8. The liquid detergent composition of claim 1 wherein the ethylene oxide content of component (a) is from about 55 to 60% by weight, based on the total weight of component (a).

9. The liquid detergent composition of claim 1 wherein $R^1$ and $R^2$ of component (b) together contain from about 8 to 10 carbon atoms.

10. The liquid detergent composition of claim 1 wherein the ethylene oxide content of component (b) is from about 55 to 60% by weight, based on the total weight of component (b).

11. The liquid detergent composition of claim 1 comprising:

(a) from about 10 to 12.5% by weight of a mixture of alkyl polyglycol ethers of Formula I wherein $R^1$ and $R^2$ together have from about 11 to 13 carbon atoms and wherein the average ethylene oxide content is from about 55 to 65% by weight, based on the weight of the mixture of alkyl polyglycol ethers;

(b) from about 10 to 12.5% by weight of a mixture of alkyl polyglycol ether of Formula I wherein $R^1$ has from about 7 to 10 carbon atoms and $R^2$ is a hydrogen atom and wherein the average content of ethylene oxide is from about 60 to 70% by weight, based on the weight of the mixture of alkyl polyglycol ethers;

(c) from about 2.5 to 5% by weight of a quaternary ammonium salt of Formula II wherein $R^3$ represents a substantially linear alkyl radical having from about 14 to 16 carbon atoms and where $X^-$ represents a chloro group, the weight ration of $C_{14}$ to $C_{16}$ alkyl radicals being about 2:3; and (d) remainder to 100% by weight comprised of water, water-miscible organic solvents, and customary additives selected from the group consisting of dyes, perfumes, preservatives, and heavy metal sequestrants.

* * * * *